US005167377A

United States Patent [19]

Chalmers

[11] Patent Number: 5,167,377

[45] Date of Patent: Dec. 1, 1992

[54] ANIMAL WASTE BAG DISPENSER

[76] Inventor: Antigone K. Chalmers, 1308 Mulford, Evanston, Ill. 60202

[21] Appl. No.: 733,315

[22] Filed: Jul. 22, 1991

Related U.S. Application Data

[63] Continuation of Ser. No. 570,800, Aug. 21, 1990, abandoned, which is a continuation of Ser. No. 269,187, Nov. 9, 1988, abandoned.

[51] Int. Cl.[5] ..... B65H 19/00; B65D 85/672

[52] U.S. Cl. ..... 242/55.2; 199/95; 199/161; 199/174; 242/55.54; 242/96

[58] Field of Search ..... 242/55.2, 55.54, 96, 242/99, 125.2, 125.3, 225; 4/661; 119/1; 211/87, 105.1, 89.1, 151, 123

[56] References Cited

U.S. PATENT DOCUMENTS

| | | | |
|---|---|---|---|
| 1,773,586 | 8/1930 | Koering | 211/123 |
| 1,871,483 | 8/1932 | Uitendaal | 242/96 |
| 2,518,328 | 8/1950 | Janonis | 211/123 X |
| 2,754,974 | 7/1956 | Larson | 211/87 |
| 4,738,385 | 4/1988 | Bell | 242/55.54 X |
| 4,741,486 | 5/1988 | Ancona et al. | 242/55.2 |

*Primary Examiner*—Daniel P. Stodola
*Assistant Examiner*—Paul Bowen
*Attorney, Agent, or Firm*—Bernard L. Kleinke; Jerry R. Potts; William Patrick Waters

[57] ABSTRACT

An animal waste plastic bag dispenser stores a cylindrical roll of bags in a rotatable manner. A central core receives the roll rotatably, and is fixed between top and bottom plates. A cutting blade is disposed between the top and bottom plates to facilitate the separation of bags from the roll seriatim. A device compresses the end of the roll of plastic bags thereagainst, to prevent or limit free rotation of the roll of plastic bags when the device is transported. After a bag is separated from its roll for use in retrieving and confining refuse, such as animal waste, the bag can be attached to the dispenser thereby establishing the user to transport a used bag to a place of disposal. In addition, the dispenser includes a device for restraining an animal during a cleanup operation so as to prevent the animal from interfering with the operation.

9 Claims, 1 Drawing Sheet

ANIMAL WASTE BAG DISPENSER

This is a continuation of application Ser. No. 07/570,800, filed on Aug. 21, 1990, now abandoned, which is a continuation of application Ser. No. 07/269,187, filed on Nov. 9, 1988, now abandoned.

TECHNICAL FIELD

The present invention relates, in general, to an animal waste bag dispenser, and it more particularly relates to such a bag dispenser, which is particularly useful for facilitating the collection and disposal of animal waste.

BACKGROUND ART

It has been long recognized, especially in the urban environment, that collection and disposal of animal wastes presents many difficulties. This is especially true in the case of pets, such as dogs, which require exercise out of doors for the maintenance of health. It is not unusual, while the dog is being exercised out of doors, that it deposits its feces at will. It is not unusual, in most urban settings, to see fecal deposits on streets, sidewalks and in parks.

Partly in recognition of the public health aspects involved in such uncontrolled outdoor activities of dogs, many communities have legislated leash laws. These laws have a two sided aspect, whereby dogs in the public environment must be controlled by a leash, and whereby provisions are made for the capture and impoundment of freely running dogs.

While leash laws have the salutary effect of curbing the freedom of dogs in the public arena by requiring the dog to be under close personal control, the public health and aesthetic aspects of dog feces in public places, have not been addressed by the leash laws. Accordingly, many communities require that any person exercising animals, especially dogs, in public, must collect and dispose of any feces produced by the animal during the time of its exercise.

As a result of these laws, it is not unusual, in an urban setting, to see a dog owner holding the leash in one hand and carrying in the other, a scoop or shovel, and some type of container. Typically, the container is in the form of disposable plastic bags. In the clean-up process, the person exercising the dog must one hand to control the dog on its leash, while attempting, usually in an awkward manner, to scoop up the feces and deposit it within the plastic bag.

The foregoing method of addressing the sanitation problem presents many practical and aesthetic difficulties for the person exercising the pet. In the first place, it requires that the person carry the shovel or scoop throughout the period of exercise, together with one or more bags in which to deposit the feces. During use, further practical and aesthetic difficulties are presented, because the person must control the animal during the cleanup operation. Generally, especially with large, active animals, such as dogs, control of the dog by its leash requires the use of one, if not both, hands. Thus, at best, only one hand is free for the scooping of the feces, and its deposit into the plastic disposable bag.

This operation can be frustrating and displeasing for the person attempting it. In many cases, the shovel or scoop does not correspond in shape or size with the mouth of the disposable bag. Thus, it is not unusual for some of the contents of the shovel to spill over the sides of the bag thereby falling to the ground, necessitating a second or a third scooping operation. Further, deposits of fecal material are frequently left on the surface of the shovel or scoop, thereby rendering the cleanup operations displeasing and undesirable. More importantly, from the aspect of public health, the person exercising the dog has a soiled shovel which must be carried in its soiled condition for the balance of the exercise period.

In view of the above, it would be highly desirable to have a portable device adapted for use in the cleanup of animal feces, which device would be readily and conveniently transportable, and yet would not require the use of a scoop or shovel in the performance of its function. In this regard, such a new and improved device could be used in a convenient manner with one hand of the user, to permit the other hand of the user to be free to grasp the end of a leash or other restraining device.

After the cleanup operation has been accomplished, the bag containing the fecal material must be transported to a place where it can be disposed of. Carrying such a bag can present difficulties for one who is exercising an active dog and yet has to carry a soiled bag to a place of disposal. Therefore, it would be highly desirable to be able to transport a used bag to a place of disposal, in a discrete manner.

Another aspect to be considered in the cleanup operations discussed herein, is the behavior of the dog being exercised. It is not uncommon for an active dog to interfere with a person cleaning up the fecal material. In this regard, it would be highly desirable to prevent, or at least greatly inhibit the dog from interfering in the cleanup operation so that the user can devote more attention to the waste disposal task.

Thus, it would be highly desirable to have an invention which would free the person exercising a dog from the requirement to carry a scoop or shovel. It would be further highly desirable to permit rapid, repetitive and sanitary cleanup of dog feces during an animal's exercise. Also, it would be desirable to be able to transport the used fecal container to a place of disposal in a discrete manner.

DISCLOSURE OF INVENTION

It is an object of the present invention to provide an easily portable device for facilitating cleanup of animal feces, without requiring scoops or other tools, and which is adapted for repetitive use.

It is a further object of the present invention to provide a new and improved device for facilitating the cleaning up of animal feces and other waste materials, which device is light in weight, portable and adapted to be repetitively used.

It is an even still further object of the present invention to provide an easily portable device for facilitating cleanup of animal feces which provides a method for transporting a used bag to a place of disposal and which, in addition, provides a capability for restraining an active dog and preventing the dog from interfering with the cleanup operation.

Briefly, the above and further objects of the present invention are realized by providing a refuse bag dispenser, which is hand held and able to be carried conveniently by the pet owner. In this manner, the user can have ready access to small, plastic-film bags, which can be slipped over the hand, while the user picks up the animal waste or other refuse material to pull the bag about the material for disposal purposes, in a clean and convenient manner.

The hand-held plastic bag dispenser stores a roll of interconnected film plastic bags being joined end to end at transverse lines of perforations. The roll is rotatably mounted about a central core or spindle between top and bottom plates. A cutting blade extends between the top and bottom plates, to help separate individual bags at the perforation lines. A device compresses the roll of plastic bags against the core to prevent free rotation of the roll of plastic bags when the device is carried, and a handle enables the dispenser to be transported.

The dispenser enables the user to gain access to one of the bags of the roll, and slip the bag over the hand. In this manner, the user can pick up the animal waste, or other refuse material, without soiling the hands, and without the need for tools. Once retrieved, the material can be retained inside the bat by pulling the bag off the hand, and about the material. Thus, the refuse can then be carried in a convenient manner to a disposal site.

The dispenser apparatus includes a wall holder to enable it to be mounted on a wall or other supporting surface. Thus, the dispenser can be used at the home or other area for dispensing bags for other reasons, such as food storage. The wall holder permits the dispenser to be removed from the wall, and carried with the user, when the user's pet is to be exercised.

The present invention is compact, and easily carried by the user, while exercising a pet, as well as storing and dispensing refuse bags at the home or other locations. Further, it is more efficient, since it allows the user to gain access, in a convenient manner, to a large number of disposable bags, one at a time. It is aesthetically pleasing in appearance, and it eliminates the need for the user to carry a soiled scoop or shovel.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
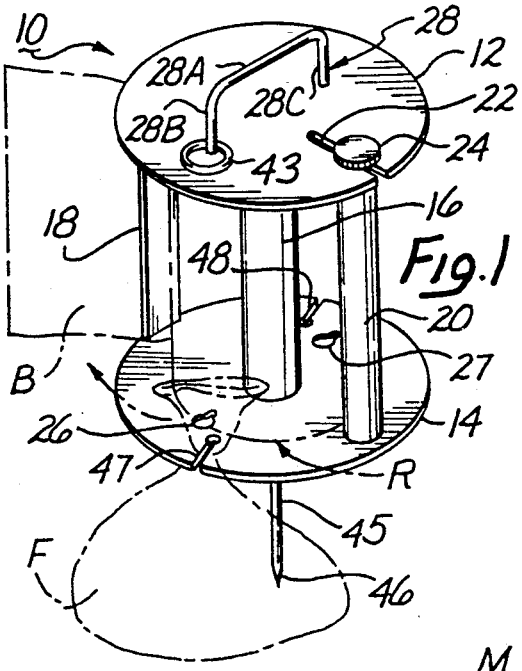
FIG. 1 is a pictorial view of a refuse bag dispenser, which is constructed in accordance with the present inveniton, and which is illustrated storing a plastic disposable bag roll, shown in broken lines, with one of the bags shown in position prior to its separation from the cylindrical roll, and with another filled bag shown attached to the dispenser.

Referring now to the drawings and more particularly to FIG. 1 thereof, there is shown a plastic bag dispenser 10, which is constructed in accordance with the present invention, and which is adapted to support and to help dispense, one at a time, refuse film plastic bags, such as a bag B from a roll R of like bags. The dispenser 10 is light in weight, and can be carried conveniently by the user, when exercising a pet. Alternatively, the dispenser 10 can be used in a stationary manner, at home, or other locations, as hereinafter described in greater detail.

Figure 2:
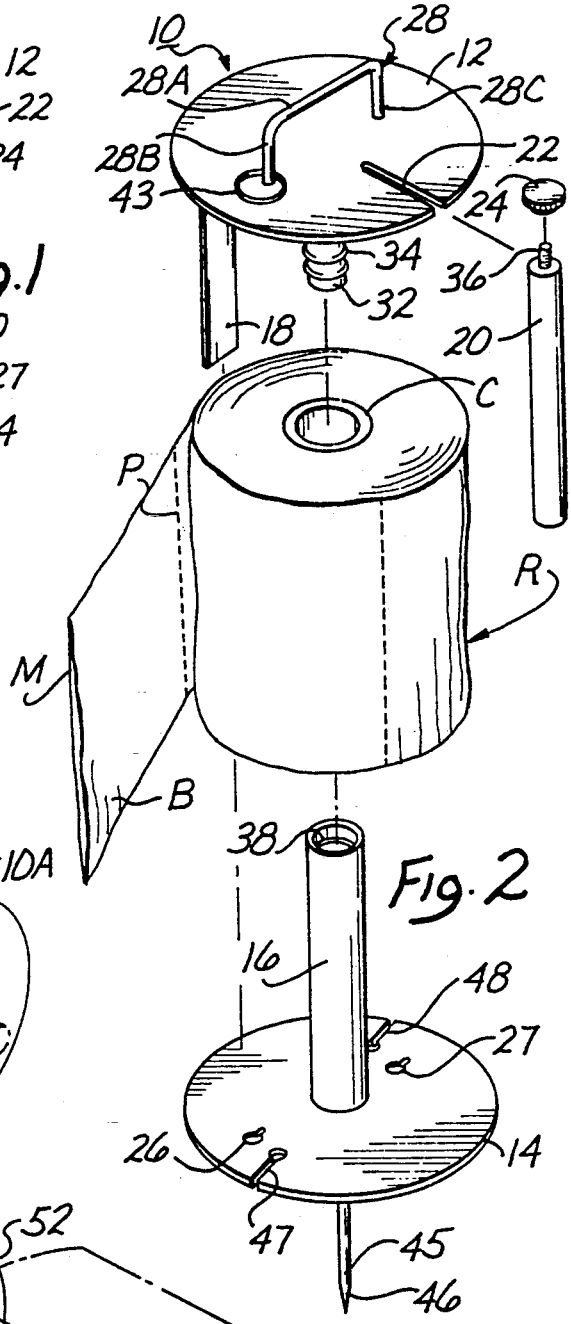
FIG. 2 is an exploded pictorial view of the dispenser of FIG. 1.

With reference now to FIGS. 1 and 2, the dispenser 10 generally comprises a top plate 12 and a parallel, spaced-apart bottom plate or base 14 between which is a centrally disposed spindle 16 for receiving the cylindrical roll R of film plastic bags rotatably thereabout. A blade 18 extends longitudinally between the top and bottom plates to aid in the separation of an individual bag, such as the bag B, from the cylindrical roll R.

In general, the cylindrical roll R of plastic bags is a web wound into the roll, and comprises a large number of bags disposed serially in a continuous "head to toe" manner. The web has a series of transverse perforations, such as the perforation P, extending transversely across the web to define the bags, and to enable one bag at a time to be torn away from the web. Each perforation extends transversely across the mouth of each individual bag so as to facilitate separation of the individual bag from the roll R when the user pulls the perforation against the knife edge of the blade 18, as indicated in FIG. 1. As shown in FIG. 2, each bag, such as the bag B, has an opened mouth, such as the mouth M, and is generally rectangular in configuration. The bags are composed of suitable film plastic material, such as polyethylene material.

The handle 28 is generally U-shaped, and has a bight portion 28A, and a pair of integrally connected depending leg portions 28B and 28C. A ring 43 is linked with the handle 28, and is shown surrounding the leg portion 28B, to enable a snap hook (not shown) or the like of an animal leash (not shown). In this manner, the dispenser 10 can be held in one hand, and the end of the animal leash is attached releasably thereto. Thus, the dispenser can be carried by one hand, which also is used to restrain the animal. As a result, the other hand is left unoccupied.

A pointed metal spike 45 depends from the underside of the bottom plate 14 to serve as a leash anchor, since the spike can be driven manually into the ground. In this manner, the dispenser can be fixed releasably to the ground for restraining the animal, while the user is free to use both hands in a convenient manner to retrieve and bag animal waste. A bottom end 46 is pointed to facilitate insertion thereof into the ground. An upper end (not shown) of the spike 45 is threaded into the central portion of the bottom plate, so that the spike can be removed, if it is not required, such as when the dispenser 10 is mounted to a stationary surface, as hereinafter described in greater detail.

In order to facilitate the transporting of a filled bag, such as a filled bag F (FIG. 1), a pair of narrow radially-extending slots 47 and 48 in the bottom plate 14 serve as bag attachment devices. In this regard, the twisted mouth portion of the filled bag (shown in broken lines in FIG. 1) is inserted manually into the slot 47, to be received and retained frictionally therewithin. In this manner, the filled bag F hangs from the bottom plate 14, when the dispenser 10 is carried by the handle 28. It should be noted that the slots 47 and 48 are opened slots in the peripheral edge of the bottom plate so that the filled bag F does not engage the sharp pointed end 46 of the spike 45.

In use, the cylindrical roll is free to rotate. The first bag of the roll is partially unwound from the roll R, and is moved opposite the cutting blade until the line of perforations P between the first bag B and the like next bag, engages the knife edge of the blade. The first bag is then separated from the roll along the perforation P.

To facilitate waste removal in a sanitary manner, the individual inserts his or her hand through the opened mouth of the disposable bag, and then picks up the fecal material. The bag is then pulled by the other hand of the user inside out, to enclose the material therewithin. The bag can then be tied or knotted at its top, thereby securely containing the fecal or other refuse material therewithin. In this manner, waste removal is accomplished without contact between the waste and the person, and without contaminating a tool (not shown), such as a shovel or scoop.

After repeated use, the cylindrical roll R of plastic bags becomes smaller in diameter, thereby tending to rotate freely about spindle 16. This unwanted rotation can cause the web of bags to become unwound inadvertently, especially when the dispenser is being carried by its user. In order to limit or prevent rotation of the roll about its axis, a restraining bar or rod 20 extends between the top and bottom plates. The top end of the rod 20 is adjustably movable radially within a radial slot 22 in the top plate 12, and is supported in a depending manner from the top plate 12. The rod 20 presses against the cylindrical roll, and thus prevents or limits it from rotating freely about its axis. Cylindrical rod 20 can be fixed releasably in position along slot 22 by means of threaded nut 24, which can be loosened manually to free the roll for rotation, if desired.

To facilitate carrying of the dispenser 10, a U-shaped handle 28 extends upwardly from the central portion of the top plate 12. For storage of the dispenser 10, a pair of keyhole slots 26 and 27 are provided for receiving a pair of wood screws (not shown) or other suitable fastening devices (not shown), so that the dispenser 10 may be mounted to a suitable support surface, such as on a wall or under a shelf.

By using the keyhole or bayonet mounting slots 26 and 27, the dispenser 10 can be secured to a mounting surface so that the dispenser 10 can be secured to a mounting surface so that the dispenser 10 may be used in a stationary manner. In this regard, bags can be removed seriation, and used for refuse removal, or for storage of materials, such as left-over food items. When the dispenser 10 is to be used in a portable manner when exercising an animal, such as a dog, the dispenser 10 can be readily removed from the wall by rotating it about its axis manually until the dispenser can be pulled free of the fastening devices (not shown). After using it in a portable manner, the dispenser can be again mounted to its supporting surface, by slipping the heads (not shown) of the fastening devices through the enlarged portions of the slots, and then rotating manually the dispenser about is axis, until the fastening device heads are captured within the narrow portions of the slots to fix the dispenser to the supporting surface.

Referring now to FIG. 2, while it may become readily apparent to one skilled in the art pertinent to the present invention that other suitable methods for joining together the top and bottom plates may also be employed, in this version of the invention, a centrally disposed depending boss 32 from (FIG. 2) having a plurality of integrally formed circumferential rings, such as circumferential ring 34, fits into the top opened end of the upright spindle 16 fixed to bottom plate or base 14 in a friction tight manner. The top and bottom plates are each circular in plan view, and the spindle is tubular and hollow throughout at least a part of its length. The bottom end of the spindle is fixed by suitable means (not shown) to the central portion of base 14.

At the inside of the spindle 16 at the top thereof, there is disposed inner circumferential grooves, such as circumferential groove 38, which is adapted to receive one of the outer circumferential rings, such as the ring 34 of axial boss 32, thereby fixing the top plate 12 detachably to the top end of the spindle 16.

As shown in FIG. 2, a core C of the bag roll R is adapted to be slipped over the top free end of the spindle 16 and to be positioned telescopically thereabout. The top plate 12 is then secured to the top of the spindle 16 by pushing manually downwardly on the top plate 12 to force the boss 32 into the opened top end of the spindle 16. In this manner, as shown in FIG. 1, the roll R is captured rotatably surrounding the spindle 16. As a result, the core C, about which is wound the web of bags forming the roll R, serves as a bearing to cooperate with the spindle 16 for facilitating axial rotation of the roll R thereabout.

With further reference to FIG. 2, it is seen that, as cylindrical roll A is diminished in its diameter, the restraining rod 20 can be moved radially inwardly along a slot 22, so as to engage and to compress the cylindrical roll against the spindle 16. As a result, the free rotation of the roll is inhibited. Rod 20 terminates in a reduced diameter upper threaded portion 36 which extends through the radial slot 22 and receives threadably a knurled nut 24 for securing the rod 20 releasably in an adjusted position along slot 22.

Figure 3:
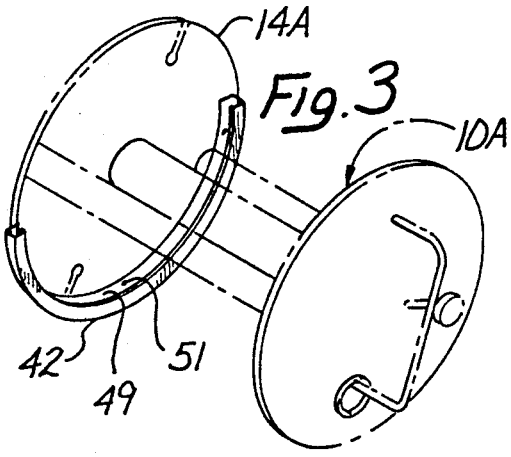
FIG. 3 is a pictorial view of a wall holder portion of the dispenser of FIG. 1, showing the dispenser itself in broken lines for illustration purposes.

In FIG. 3, there is depicted another bag dispenser 10A, which is similar to the dispenser 10 of FIG. 1, and which is shown with its bottom plate 14 mounted removably flat against a vertical supporting surface (not shown) by means of a mount 42 constructed according to the present invention. This is adapted to hold plastic bag dispenser 10A in a horizontal position, projecting from a wall (not shown), or in a depending position as from the bottom of a shelf (not shown). Mount 42 is semi-circular in shape and has a groove 49 slightly wider than the thickness of bottom plate 14 so that plastic bag dispenser 10 can be securely held by mount 42 and yet be easily removed therefrom. A plurality of fastening devices, such as a screw 51, extends through holes (not shown) in the mount 42.

The mount 42 is channel shaped throughout its length. The mount is attached to the supporting surface in an upright manner to receive the plate 14.

Figure 4:
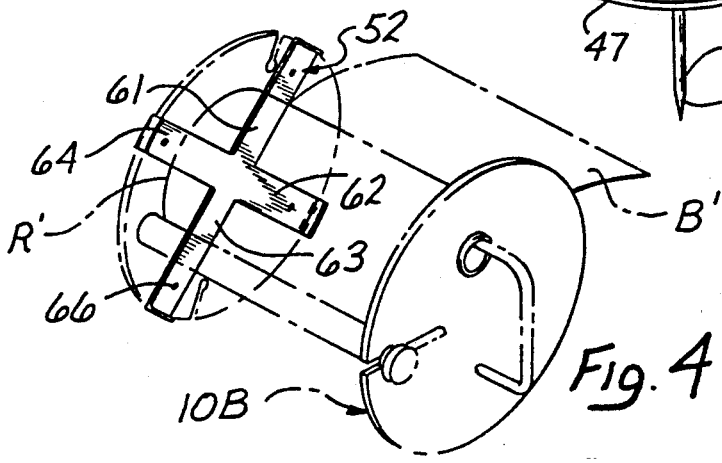
FIG. 4 is a pictorial view of another wall holder portion of the dispenser of FIG. 1, showing the dispenser itself in broken lines for illustration purposes.

FIG. 4 depicts another bag dispenser 10B on a wall (not shown) or under a shelf (not shown) bracket or mount 54 constructed according to the present invention. The dispenser 10B is similar to the dispenser 10. The mount 54 is cruciform in shape, and has four legs 61–64, each of which is bent at its ends to receive and to grip snugly plastic bag dispenser 10B in place while, at the same time, permitting it easy removal.

A plurality of fastening devices, such as a screw 66, secure the mount to the supporting surface.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A dispenser for dispensing plastic bags seriatim, from a web having a series of spaced apart perforated lines and being formed into a roll, comprising:

a pair of circular plate means for helping to retain therebetween the roll, said plate means facilitating an overall compact dispenser able to be easily transportable;

one of said circular plate means having an inner face and an outer face;

the other one of said circular plate means being dimensioned substantially equally to the first mentioned circular plate means for helping to retain the roll between said pair of plate means, said other plate means having another inner face and another outer face;

cylindrical boss means for helping to facilitate connecting together said pair of plate means in a parallel spaced apart manner, said boss means being elongated and having one of its ends fixed to the inner face of one of said pair of plate means, said boss means extending perpendicularly from about the geometric center of the last mentioned plate means a sufficient distance for helping to secure releasably together said pair of plate means;

said boss means including means defining a plurality of integrally formed circumferential rings for helping to secure releasably together said pair of plate means;

spindle means having one of its ends fixed to the inner face of the other one of said plate means, and being centrally disposed and extending perpendicularly therefrom;

said spindle means being adapted to receive the roll for permitting the web to rotate freely about said spindle means;

said spindle means including means defining an aperture at its other end, said means defining an aperture being dimensioned to receive therein in a snug removably manner said boss means for enabling said pair of circular plate means to be secured together releasably in a parallel spaced apart manner;

web cutting means having a sufficient length to extend substantially the entire distance between said pair of plate means when they are secured together removably in said spaced apart manner to engage the entire width of the web at a line of perforation thereof so that severing the web is facilitated;

means for mounting said cutting means in a cantilevered manner to the inner face of one of said circular plate means;

said cutting means including a longitudinally extending smooth edge for engaging transversely substantially the entire axial length of the web to facilitate bag separation therefrom;

restraining means mounted on said one of said plate means for helping to prevent or limit free rotation of the roll;

means for mounting said restraining means on said one of said circular plate means at a position diametrically opposed to said cutting means to restrain releasably an end portion of the web at a circumferential distance along the web between said cutting means and said restraining means, said distance being sufficient so that said end portion can be slipped out of engagement with said restraining means and the web roll rotated manually about said spindle until a desired one of said perforation lines engages said cutting means;

said restraining means including a cylindrically shaped rod extending axially substantially the entire axial length between said pair of plate means when they are secured together removably in said spaced apart manner, said rod including a threaded end portion;

means defining a path of travel of said restraining means, said means defining a path of travel including means defining an open elongated radial slot extending axially between said inner face and said outer face of the other one of said plate means for receiving said threaded end portion therein for helping to facilitate compressing the web against said spindle means as the web size diminishes;

said means defining an open elongated slot further extending radially inwardly from the outer peripheral edge of the other one of said plate means and terminating adjacent to a central portion thereof for defining a stop in the path of travel of said restraining means;

a nut for engaging the outer face of the other one of said plate means to receive threadably said threaded end portion extending axially through said radial slot;

one of said plate means further including means for attaching releasably the assembled dispenser to a supporting surface;

handle means for helping to facilitate relative movement of said pair of circular plate means in relation to a common longitudinal axis of said boss means and said spindle means to facilitate the joining or removing of said pair of plate means relative to one another, and for facilitating the carrying of the assembled dispenser;

anchoring means fixed removably to one of said circular plate means for securing the dispenser to a supporting surface; and leash connecting means for attaching a leash to said handle means, said leash connecting means being attached to said handle means.

2. A dispenser as recited in claim 1 wherein said leash connecting means is a ring.

3. A dispenser as recited in claim 1, wherein said anchoring means is a spike.

4. A dispenser as recited in claim 1, wherein one of said pair of circular plate means further includes open slot means for releasably attaching a substantially filled plastic bag thereto.

5. A dispenser as recited in claim 4 wherein said open slot means for attaching is an elongated slot having an open end portion.

6. A dispenser as recited in claim 1, wherein said spindle means is connected detachably to one of said plate means.

7. A dispenser as recited in claim 1, wherein said means for attaching said dispenser to a supporting surface includes groove means adapted to receive screw means.

8. A dispenser as recited in claim 7, wherein said groove means is arcuate in shape and includes a channel, said channel being slightly wider than the thickness of the other circular plate to facilitate the mounting of the dispenser to said supporting surface.

9. A dispenser as recited in claim 7, wherein said groove means includes a pair of spaced apart grooves being dimensioned sufficiently to receive therein mounting means for holding releasably said dispenser.

* * * * *